US005456411A

United States Patent [19]

Scott et al.

[11] Patent Number: 5,456,411

[45] Date of Patent: Oct. 10, 1995

[54] QUICK SNAP NOZZLE SYSTEM

[75] Inventors: Loren W. Scott, Carlsbad; Bradley M. Lousberg, Oceanside, both of Calif.

[73] Assignee: Hunter Industries, Inc., San Marcos, Calif.

[21] Appl. No.: 178,498

[22] Filed: Jan. 7, 1994

[51] Int. Cl.[6] ..... B05B 3/14

[52] U.S. Cl. ..... 239/73; 239/74; 239/206; 239/255; 239/391; 239/DIG. 1

[58] Field of Search ..... 239/71, 203, 206, 239/236, 255, DIG. 1, 73, 74, 390, 391; 40/299

[56] References Cited

U.S. PATENT DOCUMENTS

| | | | |
|---|---|---|---|
| 2,388,093 | 10/1945 | Smith | 239/71 X |
| 2,619,381 | 11/1952 | Jepson | 239/71 X |
| 2,991,942 | 7/1961 | Rosenkranz | 239/DIG. 1 X |
| 3,417,496 | 12/1968 | Von Meyer | 40/299 |
| 3,779,462 | 12/1973 | Bruninga | 239/390 X |
| 3,799,453 | 3/1974 | Hart | 239/391 X |
| 4,235,379 | 11/1980 | Beamer | 239/390 X |
| 4,540,125 | 9/1985 | Gorney et al. | 239/DIG. 1 X |
| 4,570,858 | 2/1986 | Bintner et al. | 239/71 X |
| 4,840,312 | 6/1989 | Tyler | 239/391 X |

*Primary Examiner*—Andres Kashnikow
*Assistant Examiner*—Lesley D. Morris
*Attorney, Agent, or Firm*—Baker, Maxham, Jester & Meador

[57] ABSTRACT

A sprinkler system for distributing water from a source substantially evenly over an area of terrain comprises a body defining a passage having an inlet connected to an outlet extending at an angle to the inlet, and at least one nozzle detachably mounted in the outlet and having an indicator tab visible from above for indicating at least one of the arc, spacing and precipitation rate.

21 Claims, 1 Drawing Sheet

QUICK SNAP NOZZLE SYSTEM

BACKGROUND OF THE INVENTION

The present invention relates to irrigation systems and pertains particularly to an improved system of matched sprinkler units and nozzles having improved ranges and areas of uniform water distribution.

The artificial distribution of water through irrigation systems is in wide use throughout the world today. There are many irrigation systems utilized, with each having its own benefits and drawbacks.

One of the most widely used systems, particularly where water is not abundant or plentiful, is the sprinkler system wherein a plurality of sprinkler units are positioned about a land area for distributing water over the surface of the land area. Such systems are widely used for lawns, golf courses, playing fields and many field crops.

The ideal sprinkler irrigation system would utilize a minimum number of valves, control units, lines and sprinkler units to achieve a substantially uniform distribution of an optimum amount of water over a given area. The optimum precipitation rate is determined to fall within the range of about 0.50 inches per hour. This presents a major problem for irregular areas since there is a large difference or variation in the precipitation rate between sprinkler units adjusted to cover different ranges and arcs.

The important parameters, including the reach or distance which a given sprinkler unit can cover, also vary with the type unit and can vary within limits by the nozzle. Many sprinkler units have replaceable nozzles with different volumes and distances of coverage. However, the matching of nozzles for a given system of sprinkler nozzles is time consuming and requires complex calculations.

Accordingly, it is desirable that a sprinkler system be available having a plurality of sprinkler nozzles that are readily replaceable providing uniform coverage over a wide range of arcs and spacings with clear indication of parameters.

SUMMARY AND OBJECTS OF THE INVENTION

Accordingly, it is a primary object of the present invention to provide a sprinkler system having replaceable nozzles with a matched precipitation rate regardless of the range and arc of coverage.

Another object of the present invention is to provide a system of replaceable nozzles having readily visible indicia of various parameters.

In accordance with the primary aspect of the present invention, a sprinkler system comprises sprinkler units having nozzles providing uniform coverage over a wide range of arcs and spacings.

In accordance with another aspect, the sprinkler units include matched snap-in nozzles with highly visible indicia of selected parameters for providing easy assembly of sprinkler units for optimum coverage.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
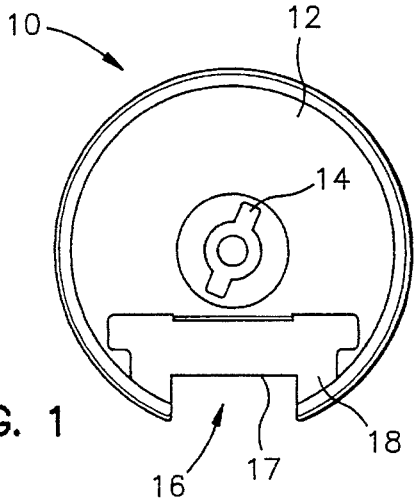
FIG. 1 is a top view of a sprinkler unit embodying a preferred embodiment of the invention showing the nozzle removed.
Figure 2:
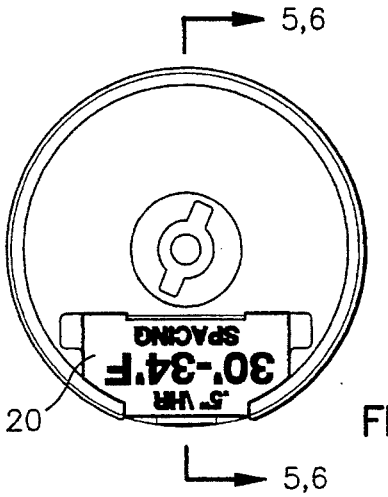
FIG. 2 is a view like FIG. 1 showing the nozzle in place.

Referring to the drawings, particularly to FIGS. 1 and 2, there is shown a top view of a sprinkler unit embodying the present invention. This sprinkler unit is of the type represented and disclosed for example in U.S. Pat. No. 4,568,024, entitled "Oscillating Sprinkler", granted Feb. 4, 1986 to the assignee of the subject application, said patent being incorporated herein by reference as though fully set forth. The sprinkler unit is turbine driven through a gear train that is reversible and has an adjustable arc. Certain units may be made full circle with or without a reversing drive. Other sprinkler units are variable arc from forty degrees up to about three-hundred sixty degrees.

An aspect of the present invention comprises a snap-in nozzle system wherein a system of nozzles are provided for selectively providing a uniform coverage or precipitation rate for various arcs and ranges for the subject sprinkler units. The sprinkler unit, designated generally by the numeral 10, is preferably of the retractable pop-up type .which is normally mounted within a housing below ground surface and pops up when in operation. However, it can be mounted as a fixed non-retractable unit in systems with retractable units.

Figure 3:
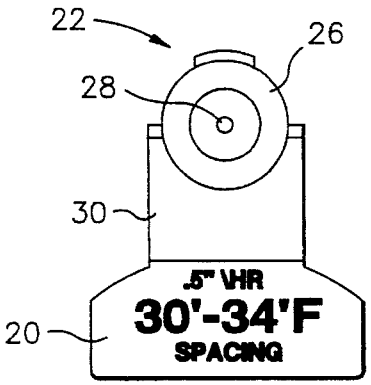
FIG. 3 is a front elevation view of a nozzle for the unit of FIG. 1.
Figure 4:
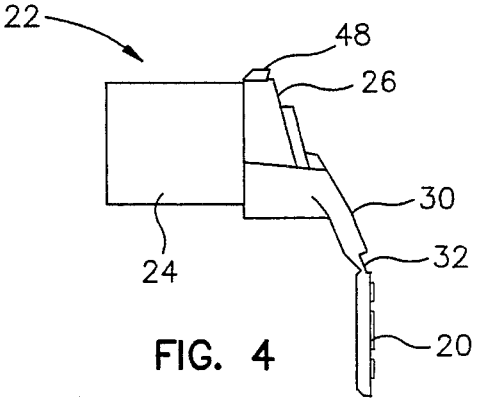
FIG. 4 is a side elevation view of the nozzle of FIG. 3.

In the illustrated embodiment, the sprinkler unit has an oscillating head with a circular top 12, with a centrally located key way adjusting slot 14 for receiving a special key or tool for rotating the adjustment device for adjusting the arc of oscillation of the sprinkler head. The distributor head of the sprinkler unit has a nozzle socket, designated generally at 16, with a slot 17 extending up the face thereof to a nozzle tab recess 18 formed in the top directly above the nozzle socket or port for receiving an indicator or indicia tab as shown in FIG. 2. The tab recess 18 is wider than the slot 17 and may have ear portions as shown. The indicia tab 20 is attached to or integral with the nozzles as illustrated in FIGS. 3 and 4, and extends to a position to the top of the sprinkler head where it may be latched into the tab recess and is visible from the top of the sprinkler unit at all times, including when the sprinkler is in its fully retracted position. The tab 20 may also serve as a retaining function to aid in retaining the snap-in nozzle in place.

The snap-in nozzle units, as illustrated in FIGS. 3 and 4, have a generally tubular cylindrical main body portion 24, with an outlet end having an angled face 26 and a centrally positioned outlet orifice 28. An extension portion 30 extends upward from the face of the nozzle and includes the indicia tab 20 attached thereto with a live hinge portion 32. This tab hinges over the top and snaps into the recess 18 as will be explained. The recess preferably has the same configuration as that of the tab.

Figure 5:
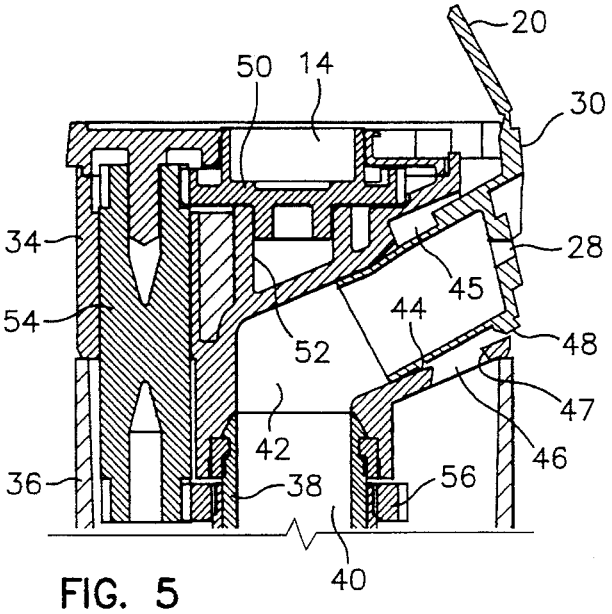
FIG. 5 is a side elevation view taken generally on line 5—5 of FIG. 2 showing a first stage of nozzle insertion.

Referring to FIG. 5, a portion of the head of the sprinkler unit 10 is illustrated in section view showing the main head components thereof. The head portion of the sprinkler unit comprises a main head body 34 mounted on an upper end of a tubular retractable housing 36 for rotation relative thereto. The head is mounted on the upper end of a rotatable tube 38, including a central through passage 40 communicating with an outlet passage 42 of the head.

The outlet passage includes a generally cylindrical socket portion 44 for receiving the tubular body portion of the snap-in nozzle 22. The socket includes a latch or detent recess 46 for receiving and engagement by a latch barb or shoulder 48 on the nozzle body. The recess 46 includes an angled shoulder 47 for engagement by the latch barb 48. The nozzle socket 44 includes a clearance recess or notch 45 directly opposite the detent recess to enable the nozzle to be displaced, as shown in FIG. 5, sufficient to pull the barb 48 out of the notch 46. The nozzle socket is also angled upward at an angle to the horizon of about fifteen to twenty-five degrees.

The orifice 28 of the nozzle unit 22 is designed to distribute a specified predetermined rate of precipitation, such as 0.5 inches per hour over a given arc and range. Each nozzle is therefore designed for a particular range or spacing and arc of coverage. The range and rate of each nozzle is achieved by the design of the orifice, which is shaped and sized to provide a given range and rate for a given operating pressure. The subject units are designed to operate at a water pressure within the range of 25 to 75 psi. The orifice may be angled up or down to achieve range and may be made larger or smaller to achieve a desirable rate of precipitation.

The indicia tab 20 is designed to identify the nozzle and provide information to the installer of various parameters, including the precipitation rate, the spacing and the arc. In the exemplary embodiment, the arc is designated by the color of the tab which is readily visible from the top of the sprinkler unit. The color may be used in the alternative to show the precipitation rate and/or the spacing. As illustrated in FIG. 3, the precipitation rate of 0.5 inches per hour is printed on the tab along with the preferred spacing of thirty to thirty-four feet. Thus, for example, nozzles will be provided in quarter, half, three-quarter and full circle ranges of arcs. Each of these may be provided in sets of five or more nozzles, with the spacing ranging from thirteen feet up to thirty-four .feet. These may also be provided in shorter spacings of about five feet up to thirty-five feet or so.

The nozzle sets may be provided on racks, that is, molded connected together for easy tear off and in colors, with the colors showing one of the parameters such as the arc. For example, a nozzle set having an arc range of from forty degrees to one-hundred thirty-five degrees may be provided in the color code brown. A half arc nozzle set may be provided in ranges of from one-hundred thirty-five degrees to two-hundred twenty-five degrees in a color code of green. A three-quarter nozzle set will be provided in an arc range from two-hundred twenty-five degrees to three-hundred fifteen degrees in a color code, for example, of blue.

A full circle nozzle set with arc ranges of from three-hundred fifteen degrees to three-hundred sixty degrees may be provided in a color code of black, for example. Each of these sets will have a nozzle for a spacing such as, thirteen to fifteen feet, a nozzle for spacing of sixteen feet to nineteen feet, a nozzle for spacing of twenty feet to twenty-four feet, a nozzle for spacing of twenty-five feet to twenty-nine feet, and a nozzle for spacing of thirty feet to thirty-four feet. Thus, a large range of matched nozzles providing a matched precipitation system is provided.

This nozzle system enables the easy selection and replacing of nozzles to achieve uniform precipitation and provides means for providing a spray uniformity over its spacing ranges. The two important parameters necessary for the installer in choosing nozzles are the arc and the spacing range required for each sprinkler. The quick snap nozzle system allows the installer to select from at least four nozzle sets of quarter, half, three-quarter and full, with at least the spacing ranges as specified above selectable for each arc. Other ranges can be easily provided with this system.

A nozzle of the desired parameters is selected and inserted into the nozzle housing and pushed all the way in to fully engage the barbed retainer. The nozzle identifier or indicia tab is then folded over and snapped into its receptacle or recess on the top of the sprinkler head.

Figure 6:
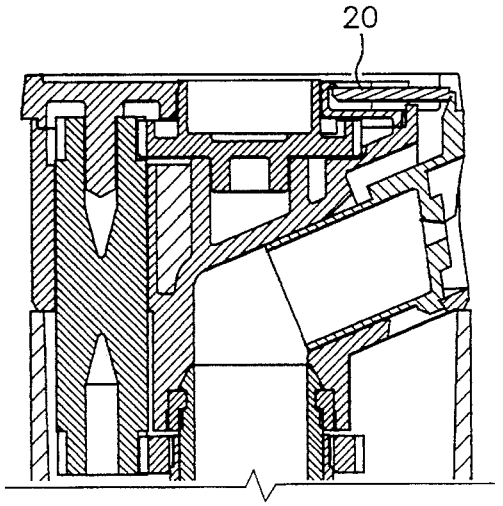
FIG. 6 is a view taken on line 6—6 of FIG. 2 showing the nozzle in place.

Referring again to FIGS. 5 and 6, the adjusting key way 14 is formed in the center of a pinion gear 50 which is rotatably mounted in a bore 52 in the distributor head body, and meshes with an idler gear 54 which in turn meshes with a gear 56 which adjusts the reversing stops for the drive gear. This adjusts the arc of oscillation of the sprinkler unit.

These sprinkler units, as pointed out above, permit the easy and economical installation of sprinkler systems for various plots of ground with minimal valving and controlling units and piping. For example, various shaped lawn areas can be laid out with a sprinkler system of the present invention with minimal complexity and with substantially uniform coverage.

This example illustrates the flexibility of the present system and the potential lay outs available. With this system, a matched precipitation can be easily provided throughout a complex geometric area to be irrigated. This can be done with less water piping, fewer control valves, and fewer controller or timers. Additional advantages include less scheduling of automatic timers.

While we have illustrated and described our invention by means of specific embodiments, it should be understood that numerous changes and modifications may be made therein without departing from the spirit and scope of the invention as defined in the appended claims:

We claim:

1. A sprinkler unit having a system of nozzles for a wide range of conditions, the sprinkler unit comprising;

a housing having an inlet and an outlet and passage means for connecting said inlet to a source of water;

a nozzle detachably mounted in said outlet for distributing a stream of water outward from said housing; and said nozzle having tab means which extends to and snaps into a recess in a top of said housing and defining indicia means for indicating a parameter taken from the group consisting of nozzle spacing, spray arc, and precipitation rate.

2. A sprinkler system according to claim 1 wherein said nozzle latches into said outlet by detent means.

3. A sprinkler system according to claim 1 wherein said tab means having a specific color for designating a selected parameter.

4. A sprinkler unit having a system of nozzles for a wide range of conditions, the sprinkler unit comprising:

a housing having a generally flat circular top with a tab receiving recess therein an inlet and an outlet and passage means for connecting said inlet to a source of water;

a nozzle detachably mounted in said outlet for distributing a stream of water outward from said housing; and said nozzle having tab means that extend over said top and into said recess for indicating a parameter taken from the group consisting of nozzle spraying, spray arc, and precipitation rate.

5. A sprinkler system according to claim 4 wherein said sprinkler unit is an adjustable arc oscillating unit.

6. A sprinkler system according to claim 4 wherein said sprinkler unit is a pop-up unit normally retractable into a housing.

7. A sprinkler system according to claim 4 wherein said sprinkler unit includes a set of nozzles having a range of from about five feet up to about thirty-five feet.

8. A sprinkler system according to claim 4 wherein said sprinkler unit includes multiple units selected from the group consisting of adjustable arc oscillating units having an arc range of from forty degrees to one-hundred thirty-five degrees, one-hundred thirty-five degrees to two-hundred twenty-five degrees, and from two-hundred twenty-five degrees to three-hundred fifteen degrees.

9. A sprinkler unit for selectively distributing water from a source substantially evenly over a selected area of terrain comprising;

a tubular housing having an inlet connected by a passage to an outlet;

a distributor head mounted on said housing at said outlet for oscillation about an axis;

a socket in said distributor head for detachably receiving a selected nozzle for a selected range of distribution; and indicating tab means for positioning into a recess on top of said distributor head for indicating an arc and a range of said nozzle.

10. A sprinkler unit according to claim 9 wherein said sprinkler unit is an adjustable arc oscillating unit.

11. A sprinkler unit according to claim 9 wherein said sprinkler unit is an adjustable arc unit and said tab means has a specific color for indicating a selected parameter.

12. A sprinkler unit according to claim 11 wherein:

said socket is generally cylindrical and includes a detent for receiving a barb on said nozzle.

13. A sprinkler unit according to claim 12 wherein said sprinkler unit has a range of arc adjustment and includes multiple nozzles selectable for a predetermined rate of precipitation for selectable ranges of spacings over said range of arc adjustment.

14. A sprinkler unit according to claim 9 wherein:

said nozzle latches into said socket by detent means;

said housing has a generally flat circular top with a tab receiving recess therein; and said tab on said nozzle extends over said top and into said recess.

15. A sprinkler unit having a system of nozzles for a wide range of conditions, the sprinkler unit comprising:

a pop-up housing normally biased to a retracted position, having an inlet and an outlet and passage means for connecting said inlet to a source of water;

said passage means forming a socket having a generally cylindrical configuration at said outlet and a detent recess in a sidewall thereof;

a nozzle detachably mounted in said socket for distributing a stream of water outward from said housing, said nozzle having a barb on a side thereof for snapping into said recess when said nozzle is laterally displaced when being inserted longitudinally into said socket; and said nozzle having tab means extending to a top of said housing and defining indicia visible from above said housing when said housing is in said retracted position for indicating a parameter taken from the group consisting of nozzle spacing, spray arc, and precipitation rate.

16. A sprinkler system according to claim 15 wherein said tab means has a specific color for designating said parameter.

17. A method of assembling and installing a system for uniform distribution of water from a plurality of sprinkler units, comprising:

selecting a plurality of sprinkler units each having a housing with an inlet communicating with an outlet and passage means for connecting said inlet to a source of water, an oscillating distributor head at said outlet and having a socket at said outlet for receiving a nozzle; and selecting and detachably mounting, for each sprinkler unit a nozzle in said socket of said distributor head for distributing a stream of water outward from said housing, wherein selecting said nozzle includes selecting said nozzle having tab means includes an upwardly extending face panel on said nozzle, and a tab hinged thereto for extending into a recess in a top of said housing for indicating a parameter taken from the group consisting of nozzle spacing spray rate.

18. A method according to claim 17 wherein each sprinkler unit is an adjustable arc oscillating unit.

19. A method according to claim 18 wherein:

said nozzle latches into said socket by detent means;

said distributor head has a generally flat circular top with a tab receiving recess therein; and said tab extends over said top and into said recess.

20. A method according to claim 19 wherein:

said detent means, comprises a barb on said nozzle for engaging a shoulder in a detent recess in said socket; and said socket includes a clearance recess disposed opposite said detent recess.

21. A method of assembling and installing a system for uniform distribution of water from a plurality of sprinkler units, comprising:

selecting a plurality of sprinkler units each having a housing with an inlet communicating with an outlet and passage means for connecting said inlet to a source of water, an oscillating distributor head at said outlet and having a socket at said outlet for receiving a nozzle, said distributor head has a slot extending from said socket to a generally flat circular top with a tab receiving recess therein; and selecting and detachably mounting, for each sprinkler unit a nozzle in said socket of said distributor head for distributing a stream of water outward from said housing, wherein selecting said nozzle includes selecting said nozzle having a face panel for extending into said slot and a hinged tab on an upper end of said panel which extends over said top and into said recess for indicating a parameter taken from the group consisting of nozzle spacing, spray arc, and precipitation rate.

* * * * *